US007530830B1

(12) United States Patent
Lenox

(10) Patent No.: US 7,530,830 B1
(45) Date of Patent: May 12, 2009

(54) MISALIGNMENT TOLERANT CONNECTOR

(75) Inventor: Carl J. S. Lenox, Oakland, CA (US)

(73) Assignee: Sunpower Corporation, San Jose, CA (US)

( * ) Notice: Subject to any disclaimer, the term of this patent is extended or adjusted under 35 U.S.C. 154(b) by 0 days.

(21) Appl. No.: 12/177,107

(22) Filed: Jul. 21, 2008

Related U.S. Application Data

(60) Provisional application No. 60/961,311, filed on Jul. 19, 2007.

(51) Int. Cl.
*H01R 13/64* (2006.01)

(52) U.S. Cl. ..... 439/248; 439/281

(58) Field of Classification Search ..... 439/205, 439/206, 247, 248, 281, 282, 358
See application file for complete search history.

(56) References Cited

U.S. PATENT DOCUMENTS 3,439,294 A * 4/1969 Flanagan et al. ..... 333/33
4,580,862 A * 4/1986 Johnson ..... 439/248
4,697,859 A 10/1987 Fisher, Jr.
6,224,421 B1 * 5/2001 Maturo, Jr. ..... 439/581
6,347,950 B1 2/2002 Yokoyama et al.
6,354,855 B2 * 3/2002 Annequin ..... 439/248
7,458,837 B2 * 12/2008 Mineo ..... 439/248

* cited by examiner

*Primary Examiner*—Thanh-Tam T Le
(74) *Attorney, Agent, or Firm*—Blakely, Sokoloff, Taylor & Zafman LLP

(57) ABSTRACT

An electrical connector having a plug assembly and a socket assembly is described. The plug assembly includes a plug body and an outer barrel with an inner conductive receptacle electrically coupled to a first conductor in the plug body. The socket assembly includes a socket body movably held within an outer housing by a positioning ring, the socket body having a socket barrel with a second conductor fixed therein to be received in the conductive receptacle of the plug assembly. The plug assembly and the socket assembly include alignment features to align the conductive receptacle and the second conductor during coupling of the socket assembly and the plug assembly.

20 Claims, 2 Drawing Sheets

MISALIGNMENT TOLERANT CONNECTOR

CROSS REFERENCE TO RELATED APPLICATIONS

This application claims the benefit of U.S. Provisional Application No. 60/961,311, filed Jul. 19, 2007, the entire contents of which are hereby incorporated by reference herein.

TECHNICAL FIELD

Embodiments of the present invention are in the field of Electrical Connectors and, in particular, Tolerant Connectors for Solar Cells.

BACKGROUND

Environmentally sealed electrical connectors are widely used in a number of applications to exclude moisture and/or dirt, which could otherwise lead to shorting of a set of coupled connectors to ground or to another electrical circuit or could degrade the quality of the electrical connection. One application for environmentally sealed electrical connectors, for example, is to electrically couple arrays or modules of photovoltaic cells, commonly known as solar cells, to a power distribution network. Typically, an environmentally sealed electrical connector includes a flexible member, such as a polymer O-ring or boot, which is fixed to one of a pair of mating halves of the connector and sealingly engages the other half when the connectors are joined or mated.

One problem with existing environmentally sealed electrical connectors is that the flexible member may interfere with the proper orientation and coupling of the two halves of the connector. This is particularly problematic in applications such as electrically coupling solar modules, where one or both halves of the electrical connector are covered by the module being coupled to the electrical circuit or where one or both halves of the connector is not hand-accessible, making the proper orientation and insertion of one half of the electrical connector into another even more difficult.

DETAILED DESCRIPTION

Figure 1A:
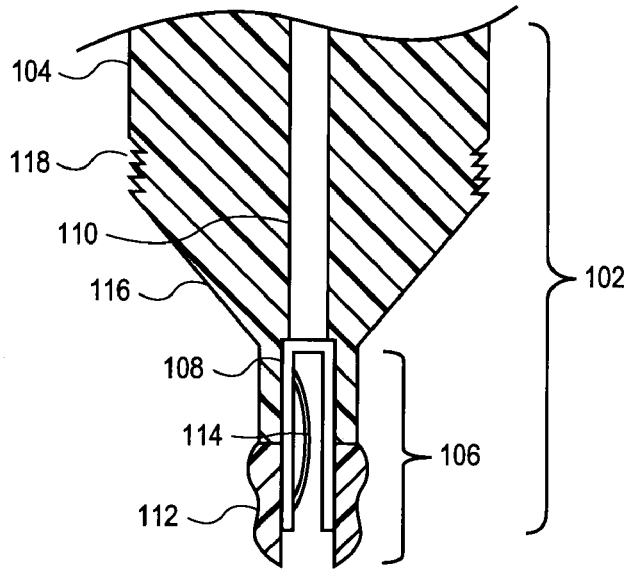
FIG. 1A is a schematic block diagram of a cross-sectional side view of a first mating half of an environmentally sealed electrical connector, in accordance with an embodiment of the present invention.

A misalignment tolerant connector is described herein. In the following description, numerous specific details are set forth, such as material regimes, in order to provide a thorough understanding of embodiments of the present invention. It will be apparent to one skilled in the art that embodiments of the present invention may be practiced without these specific details. In other instances, well-known fabrication techniques, such as molding techniques, are not described in detail in order to not unnecessarily obscure embodiments of the present invention. Furthermore, it is to be understood that the various embodiments shown in the Figures are illustrative representations and are not necessarily drawn to scale.

Reference in the description to "one embodiment" or "an embodiment" means that a particular feature, structure, or characteristic described in connection with the embodiment is included in at least one embodiment of the invention. The appearances of the phrase "in one embodiment" in various places in the specification do not necessarily all refer to the same embodiment.

Described herein is an electrical connector having a plug assembly and a socket assembly. The plug assembly may include a plug body and an outer barrel with an inner conductive receptacle electrically coupled to a first conductor in the plug body. In one embodiment, an elastomeric tip is disposed at the end of the outer barrel. The socket assembly may include a socket body movably held within an outer housing by a positioning ring, the socket body having a socket barrel with a second conductor fixed therein to be received in the conductive receptacle of the plug assembly. In one embodiment, the second conductor is electrically coupled to a third conductor through a flexible conductor extending from the socket body through the positioning ring. The plug assembly and the socket assembly may include alignment features to align the conductive receptacle and the second conductor during coupling of the socket assembly and the plug assembly. In one embodiment, the elastomeric tip of the plug assembly is provided to effect a compression fit in the socket barrel. In a specific embodiment, at least one of the plug assembly and the socket assembly is coupled with a photovoltaic module.

An electrical connector may be fabricated to have a high degree of tolerance to misalignment between separate, uncoupled mating halves of the connector. Furthermore, the electrical connector may be fabricated to be environmentally sealed upon mating of the halves of the connector. Thus, in accordance with an embodiment of the present invention, an environmentally sealed electrical connector is provided having a high tolerance to misalignment between uncoupled halves of the connector. In an embodiment, the plug assembly and the socket assembly include features, such as conical surfaces on the plug and socket bodies, to align the conductive receptacle of the plug assembly and the fixed conductor of the socket body during coupling of the assemblies. In an embodiment, the electrical connector further includes a ratcheting locking feature to secure the socket assembly and plug assembly in a coupled position.

Figure 1B:
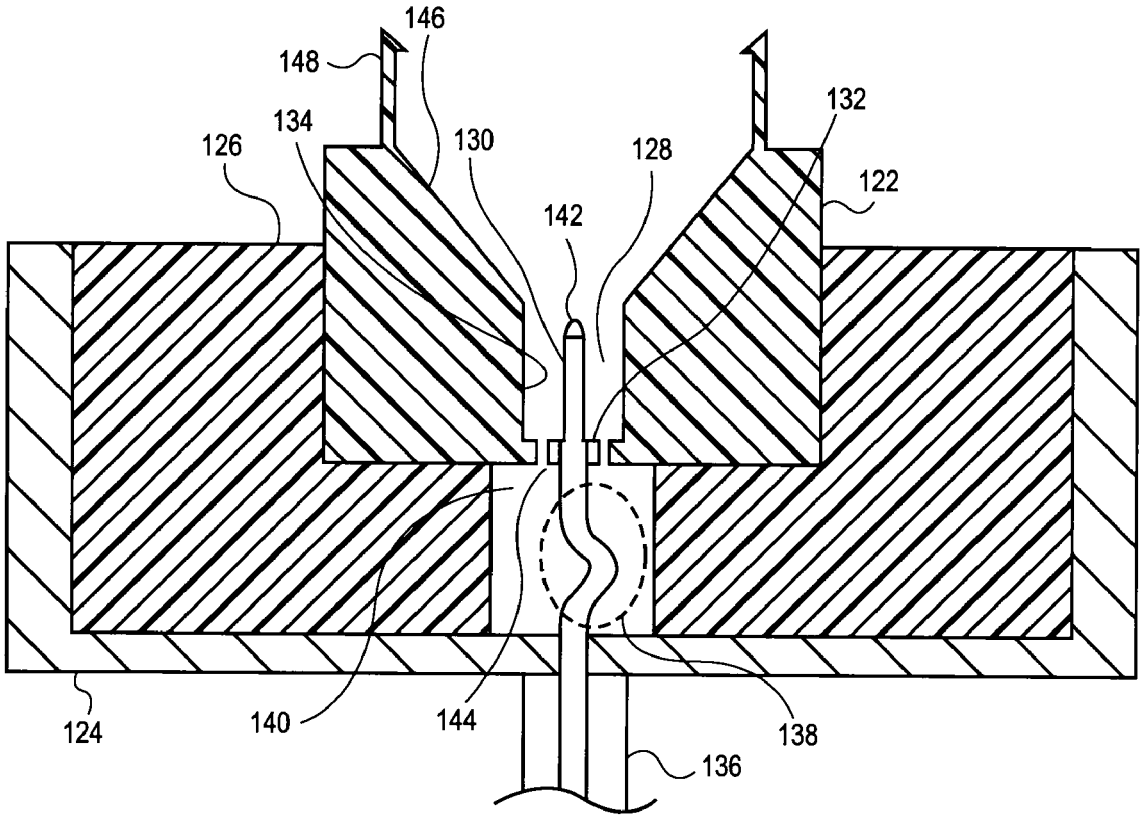
FIG. 1B is a schematic block diagram of a cross-sectional side view of a second mating half of an environmentally sealed electrical connector, in accordance with an embodiment of the present invention.

In an aspect of the present invention, an electrical connector having a plug assembly and a socket assembly is provided. FIGS. 1A and 1B are schematic block diagrams of a cross-sectional side view of mating halves of an environmentally sealed electrical connector, in accordance with an embodiment of the present invention. Referring to FIGS. 1A and 1B, an electrical connector includes a plug assembly 102 and a mating socket assembly 120. Plug assembly 102 and socket assembly 120 include alignment features to align the assemblies during the coupling or mating thereof.

Referring to FIG. 1A, plug assembly 102 includes a plug body 104 and an outer barrel 106 which has an inner conductive receptacle 108 that is electrically coupled to a first conductor 110. In accordance with an embodiment of the present invention, plug body 104 and outer barrel 106 are composed of a hard dielectric material such as, but not limited to, a hard thermoplastic. In one embodiment, outer barrel 106 further includes a rounded elastomeric tip 112 that at least partially surrounds conductive receptacle 108. In a specific embodiment, as depicted in FIG. 1A, conductive receptacle 108 further includes a positive contact feature 114 such as, but not limited to, a raised flexible conductive element or spring to ensure electrical contact between conductive receptacle 108 and a fixed conductor or pin from a socket assembly inserted therein.

Referring to FIG. 1B, socket assembly 120 includes a socket body 122 movably held within an outer housing 124 by a compliant positioning ring 126. In accordance with an embodiment of the present invention, outer housing 124 is composed of a material such as, but not limited to, a metal or a hard dielectric material (e.g., a hard thermoplastic, having the desired mechanical properties). In an embodiment, positioning ring 126 is composed of a number of metal or thermoplastic springs, or of an elastomeric material or foam as depicted in FIG. 1B. Positioning ring 126 enables socket body 122 to move relative to outer housing 124 in a range of radial and angular motions while acting as a spring to center socket body 122 in its nominal resting position, concentric to outer housing 124. In one embodiment, positioning ring 126 is held or adhered to socket body 122 such that socket body 122 cannot be separated therefrom by forces that would typically be encountered during coupling or de-coupling plug assembly 102 and socket assembly 120.

In accordance with an embodiment of the present invention, socket body 122 is composed of a hard dielectric material such as, but not limited to, a hard thermoplastic and is recessed to include a socket barrel 128 with a fixed conductor 130 (e.g., a pin) protruding from a lower surface 132 of socket body 122. Socket barrel 128 is sized and shaped to enable outer barrel 106 of plug assembly 102 to be inserted therein. In an embodiment, socket barrel 128 is sized and shaped to enable elastomeric tip 112 on the end of outer barrel 106 of plug assembly 102 to engage and seal with an inner surface 134 of socket barrel 128 when plug assembly 102 and socket assembly 120 are joined. In one embodiment, elastomeric tip 112 of plug assembly 106 is provided to effect a compression fit in socket barrel 128. As depicted in FIG. 1B, fixed conductor 130 is positioned, sized and shaped to be received in conductive receptacle 108 of plug assembly 102 when socket assembly 120 and plug assembly 102 are joined or coupled. In an embodiment, fixed conductor 130 is electrically coupled to a second conductor 136 through a flexible conductor 138 extending from socket body 122 to outer housing 124 through a void 140 in positioning ring 126. In a specific embodiment, fixed conductor 130 further includes an insulating tip guard 142, as depicted in FIG. 1B. In another specific embodiment, socket body 122 further includes weep holes 144 to substantially prevent accumulation of moisture in socket body 122. For example, in an embodiment, weep holes 144 are disposed in socket assembly 120 for water vapor transfer away from fixed conductor 130.

In accordance with an embodiment of the present invention, the alignment features of plug assembly 102 and socket assembly 120 operate to align conductive receptacle 108 and fixed conductor 130 of socket body 122 during coupling of the assemblies. In the embodiment depicted, the alignment features include a projecting, exterior conical surface 116 on plug body 104 and a recessed, interior conical surface 146 on socket body 122. In one embodiment, plug assembly 102 and socket assembly 120 are misaligned when thrust together for coupling. As a result, lateral forces generated by outer barrel 106 or conical surface 116 of plug assembly 102 striking conical surface 146 of socket body 122 act to move or deflect socket body 122 held within outer housing 124 by positioning ring 126, thereby aligning fixed conductor 130 of socket body 122 relative to conductive receptacle 108 of plug assembly 102. In accordance with an embodiment of the present invention, an electrical connector further includes a locking feature to secure socket assembly 120 and plug assembly 102 in a coupled position. For example, in one embodiment, the locking feature includes a ratcheting mechanism having a pair of tangs or pawls 148 on socket assembly 120 that engages sloped teeth 118 of plug body 104, as depicted in FIG. 1B, and to allow for a range of coupled positions.

In an aspect of the present invention, in operation, when plug assembly 102 is inserted approximately axially to socket assembly 120 but is somewhat misaligned, plug assembly 102 causes socket body 120 to move radially and angularly by imposing a force on conical surface 146 of socket body 122. This force may guide elastomeric tip 112 of plug assembly 102 towards socket barrel 128. Upon the tip of plug assembly 106 reaching socket barrel 128, the design is such that socket barrel 128 and the tip of plug assembly 106 are nominally aligned. As the tip of plug assembly 106 enters socket barrel 128, positioning ring 126 compensates for any remaining misalignment. Fixed conductor 130 and conductive receptacle 108 are designed such that there is a range of positions that are suitable to make a good electrical connection, thus compensating for situations where fixed conductor 130 cannot be fully inserted into conductive receptacle 108. In an embodiment, positive contact feature 114 enables the functioning of a range of positions that are suitable to make a good electrical connection. In one embodiment, elastomeric tip 112 substantially seals the electrical connection over a range of insertion positions. In an embodiment, locking features on plug assembly 106 and socket assembly 120, if present, are designed to engage over a range of insertion positions.

In an aspect of the present invention, a misalignment tolerant connector enables the positioning of photovoltaic modules in such a manner as to minimize the gaps between modules and the base on which they rest, as well as minimize the gaps between modules. In one embodiment, both types of gaps are minimized in order to maximize the area of a photovoltaic array relative to the area of a roof or support structure, e.g. for optimal energy capture, and to minimize the vertical space consumed by the modules. Such close spacing of photovoltaic modules may also improve aesthetics. However, in one embodiment, because modules are closely spaced to each other and the mounting surface, it is often laborious to make electrical connections between modules and extra cabling must be provided to allow connections to be made by hand. Thus, designs that allow for electrical connections to be easily made are desirable because they eliminate the need for hand connections, and also eliminate extra cabling that adds material cost, is subject to damage, and can be unsightly.

Figure 2:
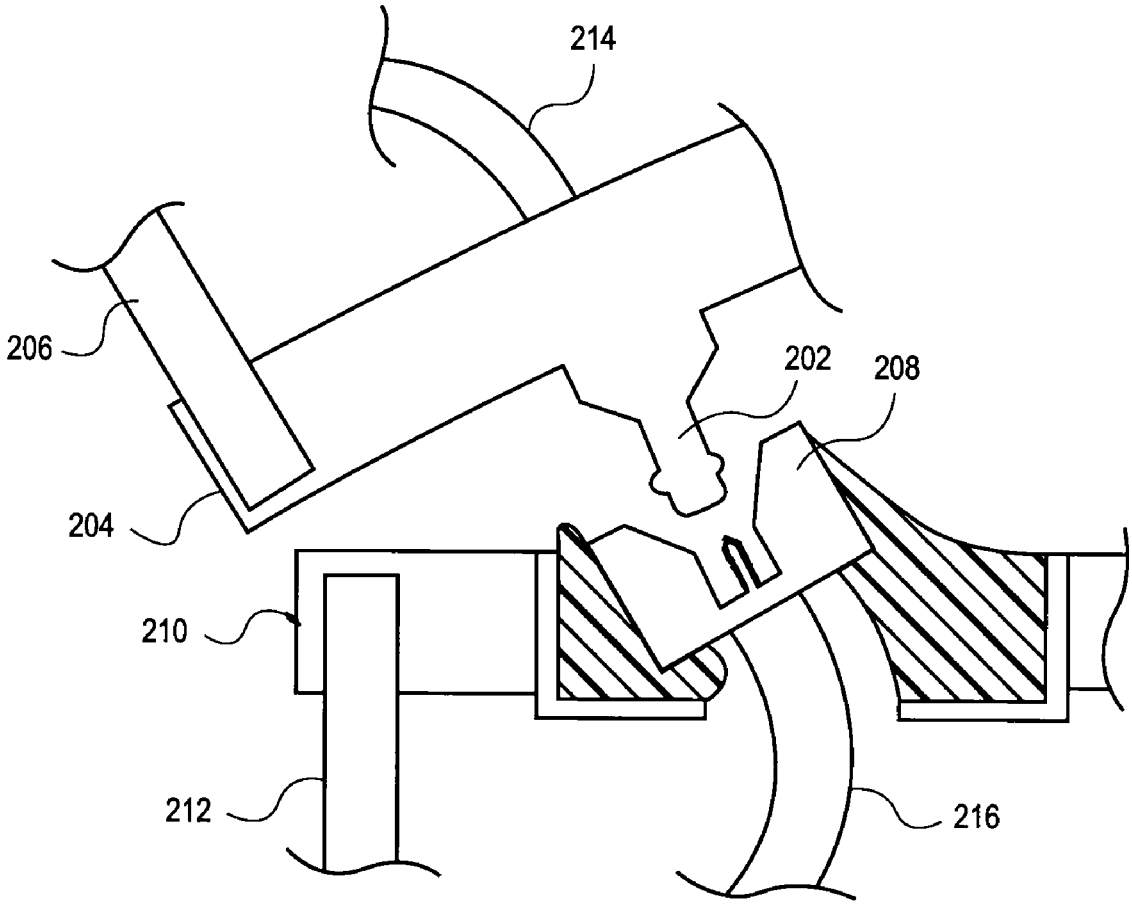
FIG. 2 illustrates a cross-sectional view representing a situation where the plug assembly and the socket assembly of an electrical connector for a photovoltaic module are misaligned in a blind setting.

However, because the modules are spaced so closely together, the point at which electrical connections are made is often visually obscured. In order to make reliable electrical connections "blind," the connectors must be capable of tolerating and correcting misalignment during the mating process. FIG. 2 illustrates a cross-sectional view representing a situation where the plug assembly and the socket assembly of an electrical connector for photovoltaic modules are misaligned in a blind setting. Referring to FIG. 2, an electrical connector is composed of a plug assembly 202 in a frame 204 coupled to a photovoltaic laminate 206. A socket assembly 208 is housed in a frame 210 coupled to another photovoltaic laminate 212. A first cable 214 is coupled to plug assembly 202 and a second cable 216 is coupled to socket assembly 208. As depicted in FIG. 2, plug assembly 202 and socket assembly 208 are misaligned. However, in accordance with an embodiment of the present invention, plug assembly 202 has a structure similar to the structure of plug assembly 102 and socket assembly 208 has a structure similar to the structure of socket assembly 120, both of which are described above in association with FIG. 1. In one embodiment, an electrical connection can still be made between plug assembly 202 and socket assembly 208, even though they are misaligned.

Thus, an electrical connector having a plug assembly and a socket assembly has been described. In accordance with an embodiment of the present invention, the plug assembly includes a plug body and an outer barrel with an inner conductive receptacle electrically coupled to a first conductor in the plug body. An elastomeric tip is disposed at the end of the outer barrel. The socket assembly includes a socket body movably held within an outer housing by a positioning ring, the socket body having a socket barrel with a second conductor fixed therein to be received in the conductive receptacle of the plug assembly. The second conductor is electrically coupled to a third conductor through a flexible conductor extending from the socket body through the positioning ring. The plug assembly and the socket assembly include alignment features to align the conductive receptacle and the second conductor during coupling of the socket assembly and the plug assembly. The elastomeric tip of the plug assembly is provided to effect a compression fit in the socket barrel. In a specific embodiment, at least one of the plug assembly and the socket assembly is coupled with a photovoltaic module.

Advantages of the electrical connector of the present invention over previous or conventional connectors include the ability to provide a reliable and environmentally sealed electrical connection under circumstances in which there may be significant, axial misalignment between the uncoupled halves of the connector. The connector is particularly advantageous for use in situations in which the connection is not hand-accessible. The inventive connectors are particularly useful for electrically connecting solar or photovoltaic modules to an electrical power grid or distribution network. Such an electrical connector may be used for module-to-module connections, series string connections, or to connect a module to a "bus" integrated in a mounting member, such as a rail.

What is claimed is:

1. An electrical connector, comprising:

a plug assembly having a plug body and an outer barrel with an inner conductive receptacle electrically coupled to a first conductor in the plug body, wherein an elastomeric tip is disposed at the end of the outer barrel; and a socket assembly having a socket body movably held within an outer housing by a positioning ring, the socket body having a socket barrel with a second conductor fixed therein to be received in the conductive receptacle of the plug assembly, the second conductor electrically coupled to a third conductor through a flexible conductor extending from the socket body through the positioning ring, wherein the plug assembly and the socket assembly comprise alignment features to align the conductive receptacle and the second conductor during coupling of the socket assembly and the plug assembly, and wherein the elastomeric tip of the plug assembly is provided to effect a compression fit in the socket barrel.

2. The electrical connector of claim 1, wherein the alignment features comprise a projecting conical surface on the plug body and a recessed conical surface on the socket body.

3. The electrical connector of claim 1, further comprising a locking feature to secure the socket assembly and the plug assembly in a coupled position.

4. The electrical connector of claim 3, wherein the locking feature comprises a ratcheting mechanism to allow for a range of coupled positions.

5. The electrical connector of claim 1, wherein the positioning ring comprises elastomeric foam.

6. The electrical connector of claim 1, wherein the positioning ring comprises a number of metal or thermoplastic spring elements.

7. The electrical connector of claim 1, wherein a positive contact is housed in the inner conductive receptacle to facilitate electrical coupling between the conductive receptacle and the fixed conductor.

8. The electrical connector of claim 7, wherein the fixed conductor further comprises an insulating tip guard.

9. The electrical connector of claim 1, wherein at least one of the plug assembly and the socket assembly is coupled with a photovoltaic module.

10. The electrical connector of claim 1, further comprising:

weep holes disposed in the socket assembly for water vapor transfer away from the second conductor.

11. An electrical connector, comprising:

a plug assembly having a plug body and an outer barrel with an inner conductive receptacle electrically coupled to a first conductor in the plug body, wherein a positive contact is housed in the inner conductive receptacle and is operable at a plurality of insertions depths; and a socket assembly having a socket body movably held within an outer housing by a positioning ring, the socket body having a socket barrel with a second conductor fixed therein to be received in the conductive receptacle of the plug assembly, wherein the plug assembly and the socket assembly include alignment features to align the conductive receptacle and the second conductor during coupling of the socket assembly and the plug assembly, wherein the plug assembly and the socket assembly comprise a locking feature to secure the socket assembly and the plug assembly in a coupled position, and wherein the locking feature comprises a ratcheting mechanism to allow for a range of coupled positions.

12. The electrical connector of claim 11, wherein the alignment features comprise a projecting conical surface on the plug body and a recessed conical surface on the socket body.

13. The electrical connector of claim 11, wherein the positioning ring comprises elastomeric foam.

14. The electrical connector of claim 11, wherein the positioning ring comprises a number of metal or thermoplastic spring elements.

15. The electrical connector of claim 11, wherein the fixed conductor further comprises an insulating tip guard.

16. The electrical connector of claim 11, wherein at least one of the plug assembly and the socket assembly is coupled with a photovoltaic module.

17. The electrical connector of claim 11, further comprising:

weep holes disposed in the socket assembly for water vapor transfer away from the second conductor.

18. The electrical connector of claim 11, wherein an elastomeric tip is disposed at the end of the outer barrel, and wherein the elastomeric tip of the plug assembly is provided to effect a compression fit in the socket barrel.

19. The electrical connector of claim 11, wherein the second conductor is electrically coupled to a third conductor through a flexible conductor extending from the socket body through the positioning ring.

20. The electrical connector of claim 11, wherein the ratcheting mechanism comprises a pair of tangs on the socket assembly that engages sloped teeth on the plug body.

* * * * *